US008438758B2

(12) United States Patent
Stonisch

(10) Patent No.: US 8,438,758 B2
(45) Date of Patent: May 14, 2013

(54) INTERCHANGEABLE FOOTWEAR RESTRAINT SYSTEM

(76) Inventor: Rudy Stonisch, Birmingham, MI (US)

( * ) Notice: Subject to any disclaimer, the term of this patent is extended or adjusted under 35 U.S.C. 154(b) by 546 days.

(21) Appl. No.: 12/717,652

(22) Filed: Mar. 4, 2010

(65) Prior Publication Data

US 2011/0214311 A1 Sep. 8, 2011

(51) Int. Cl.
*A43B 3/24* (2006.01)

(52) U.S. Cl.
USPC ..... 36/101; 36/11.5; 36/100

(58) Field of Classification Search ..... 36/101, 36/11.5, 100
See application file for complete search history.

(56) References Cited

U.S. PATENT DOCUMENTS

| | | | | |
|---|---|---|---|---|
| 2,368,314 | A * | 1/1945 | Marx | 36/11.5 |
| 3,902,259 | A * | 9/1975 | Cracco | 36/11.5 |
| 5,020,196 | A | 6/1991 | Panach et al. | |
| 5,896,684 | A * | 4/1999 | Lin | 36/101 |
| 6,349,486 | B1 * | 2/2002 | Lin | 36/101 |
| 6,848,199 | B1 * | 2/2005 | Giannelli | 36/11.5 |
| 7,219,445 | B2 * | 5/2007 | Stern et al. | 36/11.5 |
| 7,318,260 | B2 | 1/2008 | Pearce | |
| 7,318,289 | B2 * | 1/2008 | Chan | 36/11.5 |
| 7,584,555 | B2 * | 9/2009 | Pearce | 36/101 |
| 2005/0274041 | A1 | 12/2005 | Collett et al. | |
| 2006/0116483 | A1 | 6/2006 | Tonkel | |
| 2007/0245597 | A1 | 10/2007 | Krutilek et al. | |
| 2008/0098622 | A1 | 5/2008 | Berrins | |
| 2008/0110054 | A1 * | 5/2008 | Lewis | 36/101 |
| 2008/0276492 | A1 | 11/2008 | Burnett | |
| 2009/0094863 | A1 | 4/2009 | Berrins | |

FOREIGN PATENT DOCUMENTS

GB 2440898 A 2/2008

* cited by examiner

*Primary Examiner* — Ted Kavanaugh
(74) *Attorney, Agent, or Firm* — Rader, Fishman & Grauer PLLC

(57) ABSTRACT

An interchangeable footwear restraint system comprising: a sole having a top surface and a continuous bottom surface; at least one female slot clip receptacle extending into the sole, wherein the female slot clip receptacle is exposed from the top surface; and at least one male slot clip extension, wherein the male slot clip is attached to a first end of at least one strap and is received into the female slot clip connecting the strap to the sole.

19 Claims, 5 Drawing Sheets

INTERCHANGEABLE FOOTWEAR RESTRAINT SYSTEM

TECHNICAL FIELD

The present disclosure relates to an interchangeable strap system for footwear.

BACKGROUND

Over time straps of various shapes and sizes have been used in footwear such as sandals, slippers, clogs, flip-flops and T-bar sandals, for restraining the foot against a foot-bed. Footwear straps are generally either attached directly to the foot-bed or fastened using a connector. These connectors have either been hard fastened to the foot-bed or sole of the sandal or removable connectors have been attached directly to the outer surface of the foot-bed or have extended completely through the foot-bed and sole. These different connections are limited in terms of movement and typically lock the strap in place without allowing for a break-away if a need arises to safely free the foot during extreme conditions.

The limitations of the rigid connections result in minimal to no pivoting or flexing of the strap under the normal forces of the foot when walking, thus resulting in fatigue or premature failure of the strap. Additionally, when the connection extends through the sole, the connector is exposed to constant debris, which can also result in fatigue and premature failure of the connection. These premature failures result in replacement of not only the strap, which is wanted for style in some cases, but also the connector and ultimately the complete sandal.

Therefore, there is a need in the art of footwear for a strap restraint that both locks the foot in place while having a feature of safely breaking away in some circumstances under extreme loads. Additionally, there is a need for a releasable connection that promotes natural foot movement while inhibiting unwanted fatigue and failure. There is also a need for a connection system that precludes damage to the connector by keeping the connector within the sole, which eliminates exposure to debris and other elements that may create unwanted fatigue and failure.

DETAILED DESCRIPTION

Figure 1:
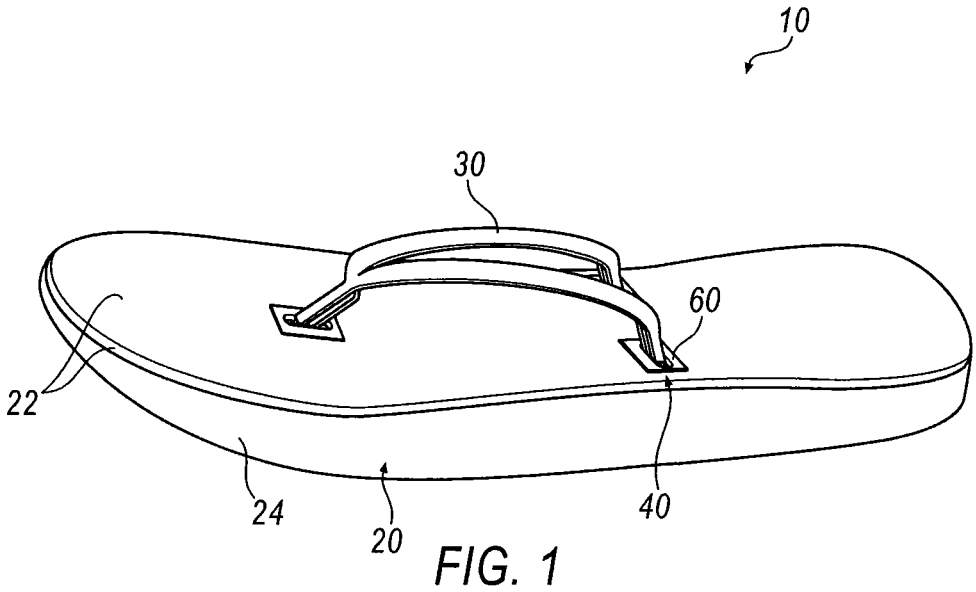
FIG. 1 illustrates a side view of an exemplary sandal having a releasable restraining strap attached to the foot-bed with an exemplary connector.

Referring now to the discussion that follows and also to the drawings, illustrative approaches to the disclosed systems and methods are shown in detail. Although the drawings represent some possible approaches, the drawings are not necessarily to scale and certain features may be exaggerated, removed, or partially sectioned to better illustrate and explain the present disclosure. Further, the descriptions set forth herein are not intended to be exhaustive or otherwise limit or restrict the claims to the precise forms and configurations shown in the drawings and disclosed in the following detailed description.

Moreover, a number of constants may be introduced in the discussion that follows. In some cases illustrative values of the constants are provided. In other cases, no specific values are given. The values of the constants will depend on characteristics of the associated hardware and the interrelationship of such characteristics with one another as well as environmental conditions of the operational conditions associated with the disclosed system.

FIG. 1 illustrates an exemplary interchangeable footwear restraining system 10 including a lower supporting member 20 and an upper restraining member 30. The disclosed restraining system may be used with any type of footwear requiring at least one strap 30 for securing a foot to a lower foot supporting member 20. Known footwear having varied strap configurations, such as, but not limited to, a sandal, a thong, a clog, a slipper, a flip-flop and a T-bar or Y-strap sandal may utilize the system 10. The supporting member 20 and the upper restraining member 30 are removeably connected by an attachment mechanism 40. The attachment mechanism 40 (see FIGS. 12 and 13) may include at least one male slot clip extension 50 (see FIGS. 5 and 6), extending into and secured within at least one female slot clip receptacle 60 (see FIGS. 7-11).

The lower supporting member 20 may include at least one foot-bed layer 22 and one sole layer 24. The layers 22, 24 may be laminated together using adhesive (not shown) or the two layers 22, 24 may be formed together in a mold (not shown). However, the layers 22, 24 may be connected utilizing any known method of footwear assembly. The foot-bed layer 22 may be, but is not limited to, a textile, leather, plastic, rubber, composite or other known material used in footwear. Additionally, multiple layers (not shown) may be employed and the combination is not limited to just the two layers 22, 24.

Figure 2:
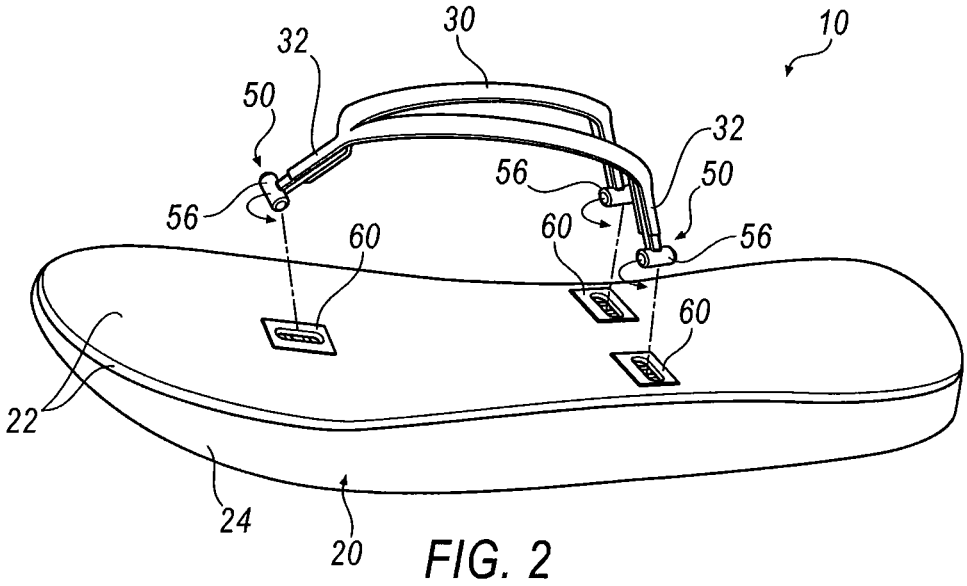
FIG. 2 illustrates a side exploded view of an exemplary sandal with a releasable restraining strap detached from the foot-bed.

FIG. 2 illustrates an exemplary interchangeable footwear restraining system 10, including a lower supporting member 20 and an upper restraining member 30. The upper restraining member 30 is shown as a strap. The strap 30 may be disengaged from the lower supporting member 20 as illustrated and replaced with an alternative strap 30 (not shown) or the same strap 30. The male extension member 50 may be generally T-shaped and may include a main attachment shaft 52 extending to and terminating at a generally round shaft 56 (see FIG. 5) or attachment flap 54 (see FIG. 6) extending to a shaft 58 that extends to and terminates at a generally round shaft 56. The attachment shaft 52 and the attachment flap 54 both resemble a T-shape and may be directly mated to at least one receiving end 32 of the strap 30. The attachment shaft/flap 52, 54 (see FIGS. 5 and 6) may be attached by sewing the strap receiving end 32 around the shaft/flap 52, 54 (see FIGS. 5 and 6). The shaft/flap 52, 54 (see FIGS. 5 and 6) may also be attached to the receiving end 32 using any known adhesive or a combination of sewing and adhesion may be employed. Once the shaft/flap 52, 54 is mated and secured to the strap 30 the combination may not be separated, thus creating a unitary connection end.

FIG. 2 further illustrates exemplary positioning of the female clip receptacle 60 on an outer perimeter and a central point between toe positions (not shown) on the foot-bed 22. It should be known that the female clip receptacle 60 extends into the foot-bed layer 22 and down into the sole layer 24. The female receptacle 60 may be exposed on the top surface of the foot-bed 22 or the female receptacle 60 may be recessed into the top surface of the foot-bed 22 allowing the foot-bed 22 to partially cover the female receptacle. Having the female receptacle 60 recessed below the top surface of the foot-bed 22 may provide additional comfort to the consumer by keeping the hard material of the female receptacle 60 away from the foot (not shown). Thus, making the sandal 10 more comfortable and aesthetically pleasing.

This exemplary positioning allows the strap 30 to be extended across a foot (not shown) and attached to the foot-bed 22 providing at least three attachment points. Additionally, it should be known that the female receptacle 60 may be positioned where the receptacle's 60 longitudinal axis runs either with or across a longitudinal axis of the foot-bed 22. The exemplary footwear restraint system 10 shown in FIGS. 1-4 illustrates the female receptacle's 60 longitudinal axis running across the foot-bed 22 axis while the female receptacle 60 positioned between the toes runs with the longitudinal axis of the foot-bed 22.

In operation, the generally round shaft 56 of the male T-shaped extension member 50 is slid into an aperture 70 that extends through a top surface 66 of the female receptacle 60. The male extension 50 may be slid to a point where the generally round shaft 56 contacts a bottom surface engagement tab 72. After contacting the bottom engagement tabs 72 the male extension 50 may be rotated approximately to a right angle position of approximately ninety degrees) (90° or until a clicking sound is heard, which indicates the generally round shaft 56 is locked in a longitudinally rotatable position in the center of the female receptacle 60 and is secured between at least two upper engagement tabs 74 and two lower engagement tabs 72. This exemplary positioning allows the connected straps 30 to pivot about the central axis of the female receptacle 60. This pivoting allows the attachment mechanism 40 to flex with the natural movement of the foot. For example, as the foot leaves the ground or walking surface the sole 24 is lifted in the air and the male extension 50 will pivot from an outwardly angled position toward the center of the foot-bed 22, then when the foot and attached footwear 10 returns to the walking surface the sole 24 contacts the walking surface and downward pressure from the foot causes the male extension 50 to pivot away from the center of the foot-bed 22 toward the outer periphery as the normal forces of the foot push in an outward direction. Additionally, an attachment mechanism 40 is positioned between the toes, which allows for forward and backward pivoting. This pivoting motion follows the normal forces of the foot longitudinally as the foot moves forward and backward when the user is walking. When walking, the foot-bed 22 is compressed as the sole 24 is in contact with the walking surface and the attachment mechanism 40 may pivot in a forward direction. When the user lifts the foot and attached footwear 10 the attachment mechanism will pivot in an opposite direction. The pivoting of the attachment mechanism 40 provides a greater reduction in fatigue and failure while providing greater comfort for the user.

Figure 3:
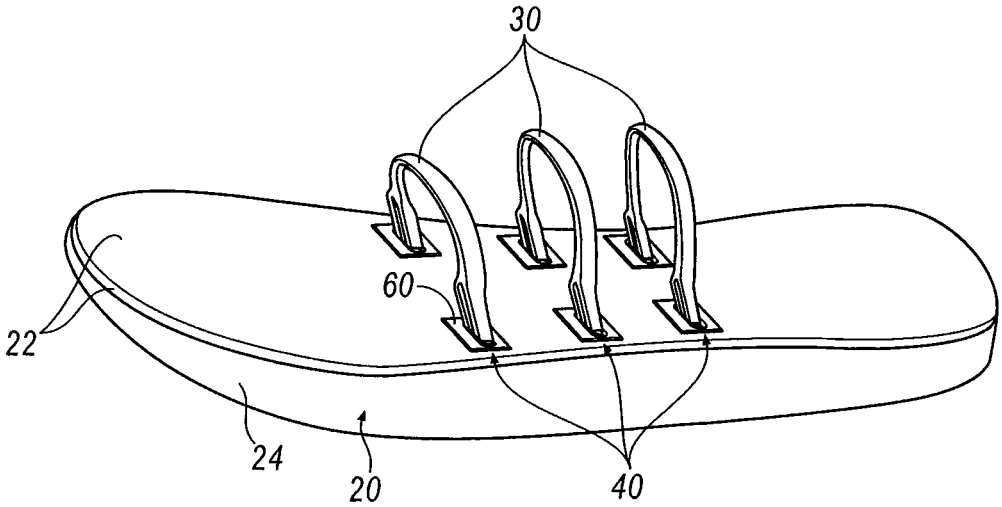
FIG. 3 illustrates a side view of an exemplary sandal having a plurality of releasable restraining straps attached to the foot-bed.

FIG. 3 illustrates an additional exemplary interchangeable footwear restraining system 10 having a plurality of straps 30 and attachment mechanisms 40. As shown, a plurality of female receptacles 60 are positioned on the outer periphery of the foot-bed 22 with the receptacle 60 axes crossing the foot-bed 22 axes. Again, this allows the plurality of straps 30 to flex inwardly and outwardly when the user is walking. The plurality of straps 30 extend across the foot-bed 22, and ultimately a foot (not shown), to create an additional type of sandal. What is illustrated is merely an example of having different mounting configurations and by no means limits the possibility of having different configurations that are not listed herein.

Figure 4:
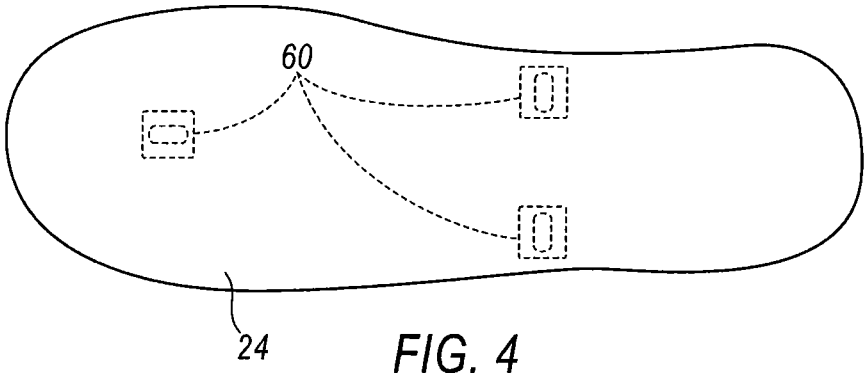
FIG. 4 illustrates a bottom view of an exemplary sandal sole with an exemplary connector shown in phantom.

FIG. 4 illustrates a bottom view of the exemplary interchangeable footwear restraining system 10 sole layer 24. As illustrated, the bottom surface of the sole layer 24 may be smooth and continuous such that it is uninterrupted by any portion of attachment mechanism 40. This surface may also include a sole layer 24 having lugs or other traction layers (not shown) that cover and conceal the attachment mechanism 40. This view further illustrates the female receptacles 60 shown in phantom as the receptacles 60 do not extend through the sole layer 24. By having the continuous bottom surface of the sole layer 24 the receptacles 60 are protected from damage due to contact with the ground or other environmental elements. Additionally, when the sole is contacting the walking surface the receptacles will be contacting the flexible surface of the sole layer 24 and not directly contacting the walking surface, thus providing the user with a more comfortable step.

Figure 5:
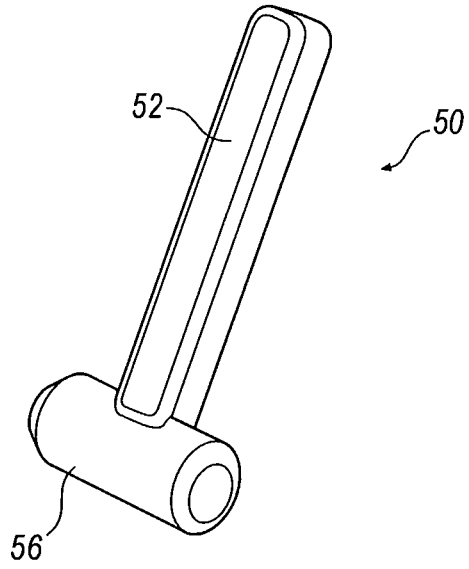
FIG. 5 illustrates an isometric view of an exemplary T-shaped male extension having an attachment shaft.
Figure 6:
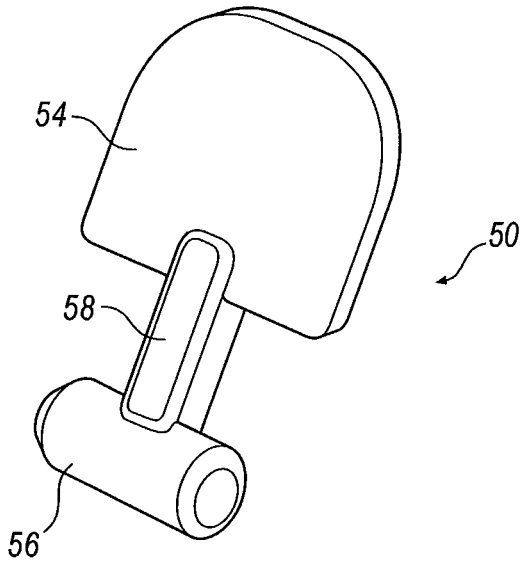
FIG. 6 illustrates an isometric view of an exemplary T-shaped male extension having an attachment flap.

FIGS. 5 and 6 illustrate exemplary generally T-shaped male extensions 50. FIG. 5 illustrates the male extension 50 having the attachment shaft 52 extending into and abutting the generally round shaft 56. FIG. 6 illustrates the male extension 50 having the attachment flap 54 extending into an extension shaft 58 and further into and abutting the generally round shaft 56. The male extension 50 may be constructed as a solitary unit. The male extension 50 may be made from at least one of a plastic, metal, composite or other structurally load bearing material. The male extension 50 material may include a reinforcing fiber such as, but not limited to, fiberglass to provide additional strength to the extension 50. Additionally, the male extension 50 is not limited to using a round shaft 56. The round shaft 56 may be replaced with a spherical or other known attaching point.

Figure 7:
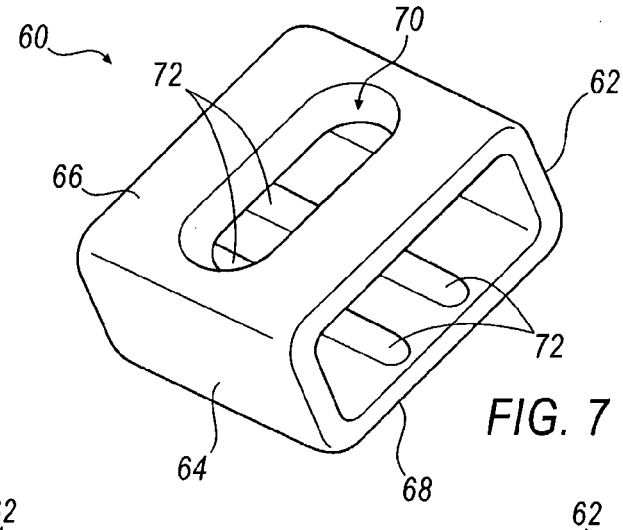
FIG. 7 illustrates an isometric view of an exemplary female slot clip receptacle.

FIG. 7 illustrates an isometric view of the exemplary female receptacle 60. The female receptacle 60 is essentially a box having a top side 66, a bottom side 68, a front side 62 and a rear side 64. The female receptacle 60 is open on a left and right side thus creating a tunnel through the internal portion. The top side 66 includes a through aperture 70 that opens the top side 66 to the internal portion of the female receptacle. The through aperture 70 may be an oval shape that extends the length of the female receptacle 60 and is centered on the longitudinal center line. The top side includes an internal surface having top engagement tabs 74 and the bottom side 68 includes bottom engagement tabs 72. The engagement tabs 72, 74 act as a locking and centering mechanism that engages the generally round shaft 56 of the male extension 50. The engagement tabs 72, 74 extend inwardly and run perpendicular to the oval of the through aperture 70. The female receptacle 60 may be constructed from at least one of a plastic, metal, composite or other structurally load bearing material. The female receptacle 60 material may include a reinforcing fiber such as, but not limited to fiberglass to provide additional strength to the extension 50. However, the female receptacle may include a cross-section ratio in the thickness of the top side 66 of the female receptacle 60 to break away in some circumstances if an inordinate amount of stress is applied to the strap 30. This feature results in the male extension 50 pulling through the top side 66 of the female receptacle. This may only happen during extreme circumstances and a greater than normal upward force. This break away feature is merely a safety or precautionary measure so as to not injure the foot during extreme upward force application.

Figure 8:
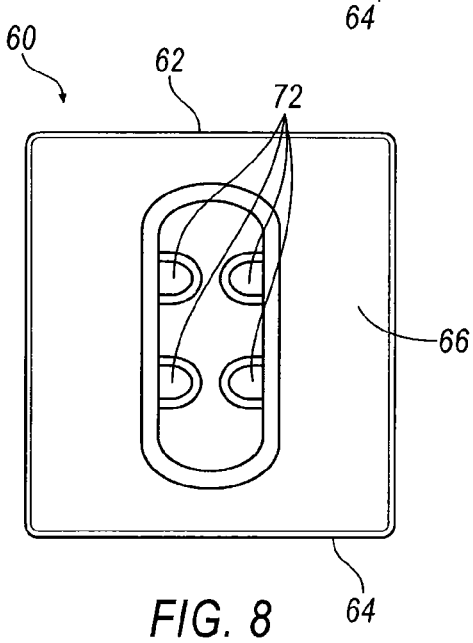
FIG. 8 illustrates a top view of an exemplary female slot clip receptacle.

FIG. 8 illustrates a top view of the exemplary female receptacle 60. The aperture 70 is clearly illustrated extending through the top side 66 and opening up into a cavity within the outer surface of the female receptacle 60. The bottom side engagement tabs 74 are shown to extend the approximate width of the bottom surface. As illustrated four tabs 74 are shown with a break in the middle. The tabs 74, as stated previously, provide a centering and locking mechanism for the generally round extension.

Figure 9:
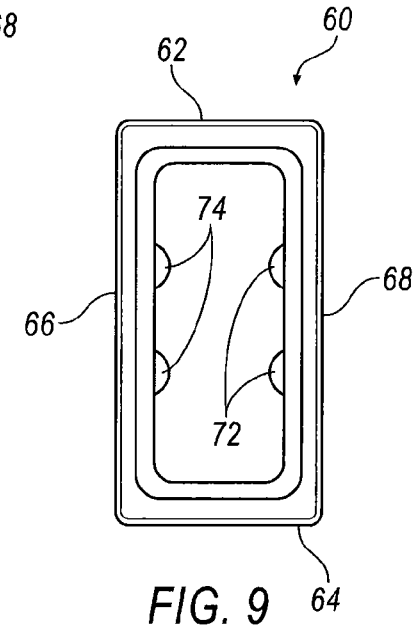
FIG. 9 illustrates a side view of an exemplary female slot clip receptacle.

FIG. 9 illustrates a side view of the exemplary female receptacle 60. The side view illustrates the lower and upper engagement tabs 72, 74 that extend across the female receptacle 60. The tabs 72, 74 may be of any size that corresponds with the diameter of the generally round shaft 56. For mere illustration purposes, the wall thickness of the female receptacle 60 may be 20 percent of the total receptacle 60 height. The tabs 72, 74 may have a radius that is approximately 20 percent of the wall thickness and extend inwardly toward a geo-dimensional center line of the female receptacle 60. The tabs may be offset from the front side 62 by approximately 35 percent of the overall length of the female receptacle 60. The spacing may provide a reasonable gap for the generally round shaft 56 of the male T-shaped extension 50 to rotate while being locked longitudinally between the lower and upper engagement tabs 72, 74.

Figure 10:
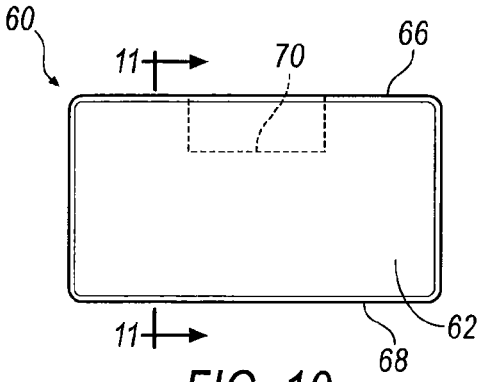
FIG. 10 illustrates a side view of an exemplary female slot clip receptacle having section lines.

FIG. 10 illustrates a front view of the exemplary female receptacle 60. The front view illustrates the closed front side 62 of the female receptacle 60. The front view also illustrates the aperture 70 in phantom as well as the top side 66 and the bottom side 68. The view further illustrates cross-sectional lines 11 for FIG. 11.

Figure 11:
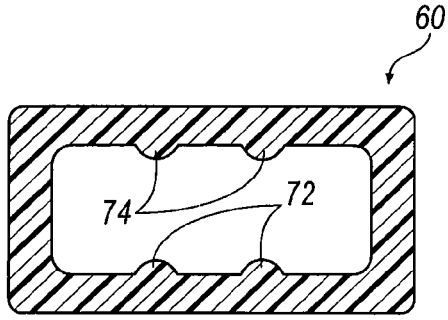
FIG. 11 illustrates a cross-sectional view of an exemplary female slot clip receptacle.

FIG. 11 illustrates a cross-sectional view of the exemplary female receptacle 60 along section line 11 in FIG. 10. The cross-section further illustrates the internal area of the receptacle 60 as well as the positioning of the lower and upper engagement tabs 72, 74.

Figure 12:
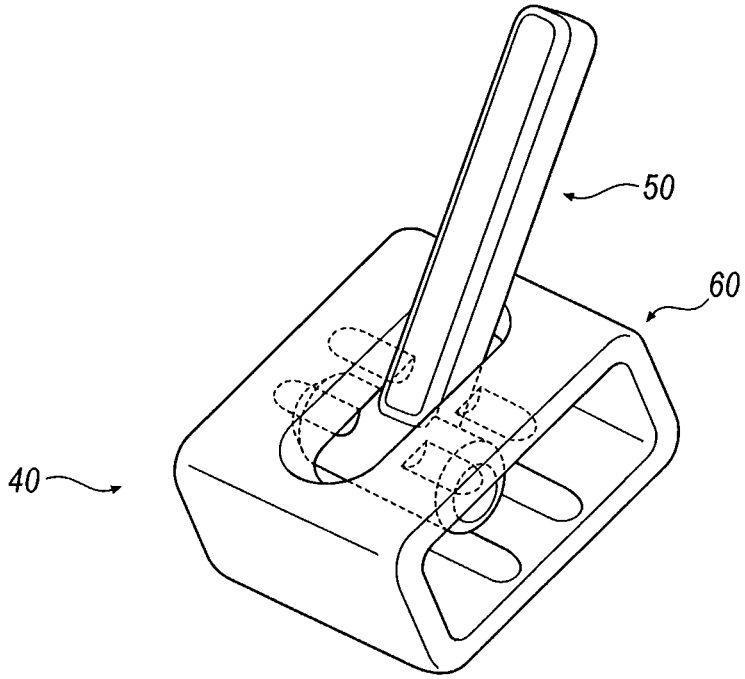
FIG. 12 illustrates an isometric view of an exemplary attachment mechanism with the male extension having an attachment shaft.
Figure 13:
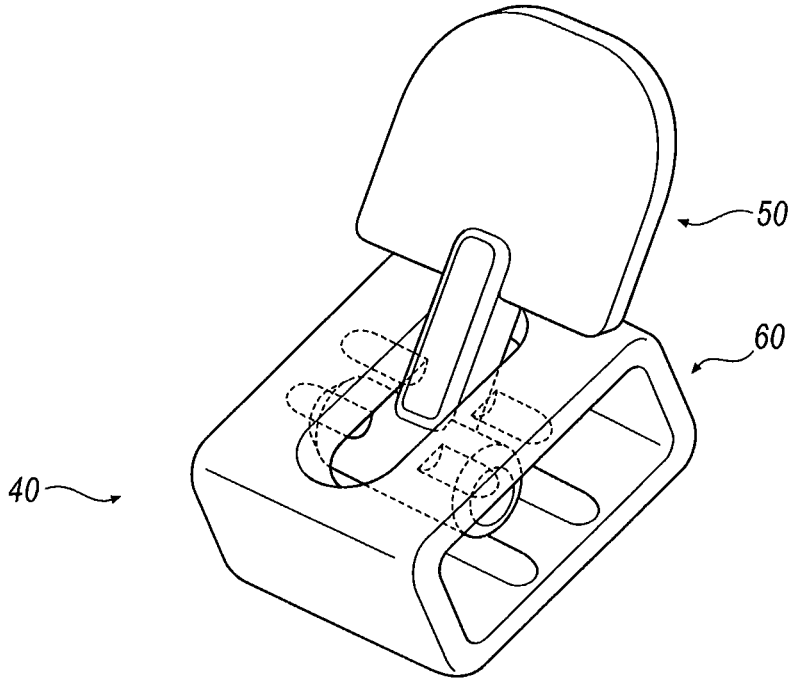
FIG. 13 illustrates an isometric view of an exemplary attachment mechanism with the male extension having an attachment flap.

FIGS. 12 and 13 illustrate isometric views of the exemplary attachment mechanism 40 with the male extension 50 inserted, rotated and locked into the female receptacle 60 and between the engagement tabs 72, 74. The attachment mechanism 40, when assembled, allows pivoting rotation about the generally round shaft 56. The male extension 50 may also slide from side to side a negligible amount due to the clearance between the shaft 52, 58 and the aperture 70. Additionally, the male extension 50 may pivot forward and back to the outer limits of the aperture 70, which provides enough movement to minimize stresses on the attachment mechanism 40.

Additionally, an interchangeable footwear 10 kit may be provided. The kit may include a plurality of different interchangeable straps 30 with varied design and color choices having an integrated male extension 50 and at least one multi-layered supporting member 20 having integrated female receptacles 60 inserted into the multi-layered supporting member 20.

Assembly of the footwear 10 may include at least the steps of forming at least one sole layer 24, applying an adhesive (not shown), placing the female receptacle 60 on the sole layer 24, placing the foot-bed layer 22 directly on top of the sole layer 24 encapsulating the female receptacle 60 and applying heat and pressure (not shown) to the two layers 22, 24 causing the layers 22, 24 to bind together with the female receptacle 60. During a cooling process, the upper restraint 30 may be formed by taking a textile or other material used in a strap, sewing or adhering the textile on to itself, leaving the decorative portion exteriorly exposed and at least one end open for insertion of the male extension 50, which is positioned inside a fold. Once an adhesive is applied to the male extension 50, the strap end is completely folded around the extension 50 and is sewn tight. Thus, the male extension 50 becomes an integral part of the strap 30.

Final assembly comes when the user selects a finished upper restraint strap 30 and positions the male extension 50, slides the male extension 50 into the female receptacle 60 and rotates the male extension 50, 90 degrees to lock the strap 30 to the lower supporting member 20.

Although the method steps are listed in an exemplary order, the steps may be performed in differing orders. Furthermore, as noted above, one or more steps may be eliminated and other exemplary broaching steps may be added between the initial stage and the final stage.

The present disclosure has been particularly shown and described with reference to the foregoing illustrations, which are merely illustrative of the best modes for carrying out the disclosure. It should be understood by those skilled in the art that various alternatives to the illustrations of the disclosure described herein may be employed in practicing the disclosure without departing from the spirit and scope of the disclosure as defined in the following claims. It is intended that the following claims define the scope of the disclosure and that the method and apparatus within the scope of these claims and their equivalents be covered thereby. This description of the disclosure should be understood to include all novel and non-obvious combinations of elements described herein, and claims may be presented in this or a later application to any novel and non-obvious combination of these elements. Moreover, the foregoing illustrations are illustrative, and no single feature or element is essential to all possible combinations that may be claimed in this or a later application.

All terms used in the claims are intended to be given their broadest reasonable constructions and their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary.

What is claimed is:

1. An interchangeable footwear restraint system comprising:

a sole having a top surface and a bottom surface, wherein the top surface includes at least one recess;

at least one female slot clip receptacle extending into the sole, wherein the female slot clip receptacle is exposed from the top surface; and at least one male slot clip extension having a first end and an opposing second end, wherein the male slot clip extension first end is attached to a first end of at least one strap and the opposing second end is received into the female slot clip receptacle removeably connecting the strap to the sole;

wherein the female slot clip receptacle further comprises an internal cavity having a plurality of horizontally extending raised protrusions, wherein the raised protrusions extend inwardly from a top and bottom surface of the cavity to lock the male slot clip extension into a position for straight line motion.

2. The interchangeable footwear restraint system according to claim 1, wherein the sole is comprised of a plurality of layers.

3. The interchangeable footwear restraint system according to claim 1, wherein the bottom surface is uninterrupted by the female slot clip receptacle.

4. The interchangeable footwear restraint system according to claim 1, wherein the plurality of layers are laminated together into a single base.

5. The interchangeable footwear restraint system according to claim 1, wherein the protrusions align the male slot clip extension centrally in the female slot clip receptacle.

6. The interchangeable footwear restraint system according to claim 1, wherein the female slot clip receptacle includes at least one aperture.

7. The interchangeable footwear restraint system according to claim 6, wherein the aperture is generally rectangular in shape.

8. The interchangeable footwear restraint system according to claim 1, wherein the male slot clip extension is generally T-shaped.

9. The interchangeable footwear restraint system according to claim 1, further comprising a plurality of straps connected to and extending across the top surface of the sole, wherein the straps pivot in toward and away from a top surface longitudinal center line.

10. The interchangeable footwear restraint system according to claim 1, wherein the female slot clip receptacle is hidden beneath the sole top surface.

11. An interchangeable footwear kit, comprising:

a sole;

at least one female receptacle positioned in the sole, wherein the female receptacle is partially visible from a top surface of the sole and the bottom surface is uninterrupted by the female receptacle;

at least one strap; and at least one male toggle having a first insertion end and a second engagement end, wherein the first insertion end is fixedly inserted in an end of the strap and the engagement end is removeably inserted into the female receptacle, wherein the toggle pivots in a first direction within the receptacle;

wherein the female receptacle further comprises an internal cavity having plurality of horizontally extending raised protrusions, wherein the raised protrusions extend inwardly from a top and bottom surface of the cavity to lock the male toggle into a position for straight line motion.

12. The interchangeable footwear kit of claim 11, wherein the strap is a Y-strap having at least three toggles.

13. The interchangeable footwear kit of claim 11, wherein the strap is a crossover strap having toggles inserted in a first and second end of the strap, wherein the crossover strap is attached on a first and second side of the sole adjacent a sole outer periphery.

14. The interchangeable footwear kit of claim 11, further comprising a plurality of straps.

15. The interchangeable footwear kit of claim 11, further comprising a plurality of female receptacles.

16. The interchangeable footwear kit of claim 11, wherein the toggle is two generally cylindrical shapes connected perpendicularly to create a T-shape.

17. The interchangeable footwear kit of claim 11, wherein the sole further comprises a plurality of layers laminated together.

18. The interchangeable footwear kit of claim 11, wherein the female receptacle is covered by a sole top layer having a plurality of apertures.

19. The interchangeable footwear kit of claim 11, wherein the raised protrusions align the male toggle centrally in the female receptacle.

* * * * *